US005386840A

United States Patent [19]

Lane

[11] Patent Number: 5,386,840

[45] Date of Patent: Feb. 7, 1995

[54] FLOATABLE TOOTHPICK ASSEMBLY

[76] Inventor: Terry Lane, 1925 Brickell Ave., Apt. D810, Miami, Fla. 33129

[21] Appl. No.: 180,287

[22] Filed: Jan. 12, 1994

Related U.S. Application Data

[63] Continuation-in-part of Ser. No. 116,577, Sep. 7, 1993.

[51] Int. Cl.[6] ..... A45D 8/18

[52] U.S. Cl. ..... 132/329; 132/321; D7/683; D7/684

[58] Field of Search ..... 132/321, 329; 366/129, 366/343; D28/64; D7/635, 636, 683, 684; D1/102, 104, 105; D3/6; 239/33; 99/419; 294/61

[56] References Cited

U.S. PATENT DOCUMENTS

| | | | |
|---|---|---|---|
| D. 207,412 | 4/1967 | LaBarbera | D7/684 |
| 1,253,579 | 1/1918 | Deanes | 239/33 |
| 1,916,646 | 7/1933 | Tycko | 239/33 |
| 1,991,871 | 2/1935 | Sindler | D7/683 |
| 3,078,856 | 2/1963 | Bender et al. | 132/321 |
| 3,099,565 | 7/1963 | Neuhauser | 239/33 |
| 3,646,628 | 3/1972 | Halford | 132/329 |

FOREIGN PATENT DOCUMENTS

| | | | |
|---|---|---|---|
| 471232 | 5/1952 | Italy | 239/33 |
| 7908774 | 7/1981 | Netherlands | 239/33 |

*Primary Examiner*—Gene Mancene
*Assistant Examiner*—Frank A. LaViola
*Attorney, Agent, or Firm*—Malloy & Malloy

[57] ABSTRACT

An improved floatable toothpick assembly which includes a pointed lower end to piercingly connect to a piece of garnish, such as an olive or a cherry, and a buoyant float about the toothpick and adjacent the upper end zone of the toothpick so as to float a piece of garnish in a beverage which can be retrieved by grasping the upper end zone of the toothpick.

9 Claims, 1 Drawing Sheet

FIG. 1
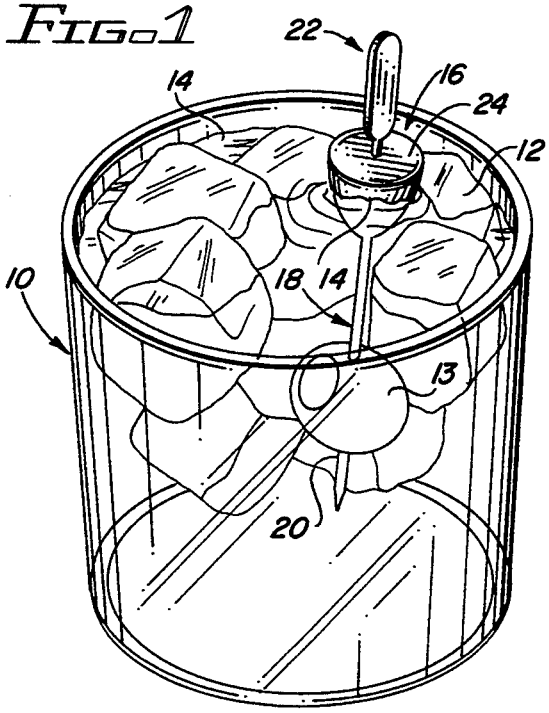
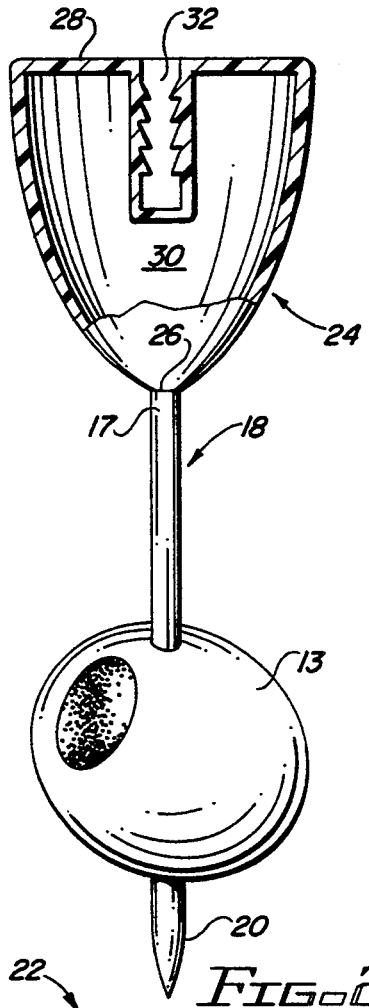
FIG. 2
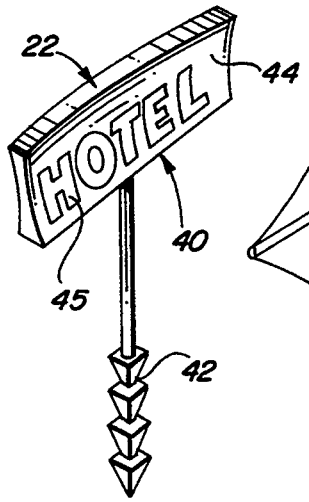
FIG. 3
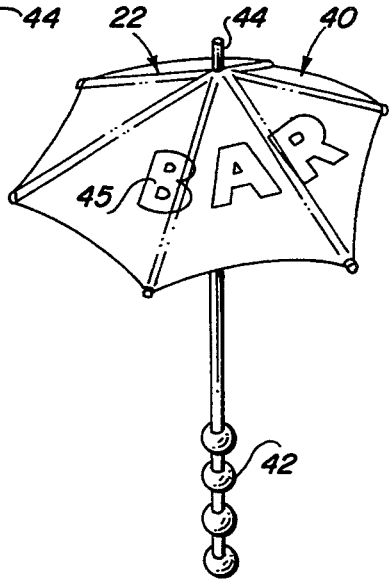
FIG. 4
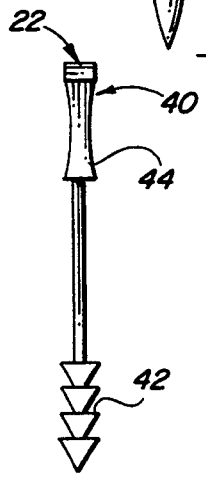
FIG. 5

FLOATABLE TOOTHPICK ASSEMBLY

BACKGROUND OF THE INVENTION

The present is a continuation in part to the previously filed application assigned Ser. No. 08/116,577, filed Sep. 7, 1993 pending.

1. Field of the Invention

This invention relates to an improved floatable toothpick assembly which includes a toothpick and a float adjacent the upper end of the toothpick and an upper end segment adapted to be lockingly and interchangeably secured in the float so as to protrude from a beverage and be visible thereover.

2. Description of the Related Art

It has often been noticed that persons sometimes like to eat a cherry or an olive in an alcoholic beverage particularly. Often times, it is fairly difficult to do this because retrieval of the piece of garnish is somewhat difficult. Often people are observed using spoons, forks, or indeed their fingers in order to reach into a drink and retrieve the piece of garnish.

Further, in the manufacture of a floatable toothpick assembly having an upper end segment which protrudes from a surface of the beverage, it would be beneficial to provide for the interchangeable manufacture of the upper end segment. A benefit would entail the ability to manufacture large quantities of "stock" parts and to produce only the desired quantity of upper end segments, especially in circumstances wherein the decorative, grippable portion of the upper end segment bears advertising indicia thereon.

SUMMARY OF THE INVENTION

This invention is of an improved floatable toothpick assembly which includes an elongate segment having a lower end zone with a pointed tip to attach to garnish and an opposite upper end zone. The elongate segment is generally cylindrical in cross-section and is of a uniform diameter along its main length between the end zones. Also included as part of the assembly are buoyant symmetrical float means. The float means include an upper surface, a lower end, and a side surface extending between the upper surface and lower end. In use, the float means are disposed adjacent the upper toothpick end zone.

The float means are structured to have sufficient buoyancy to float the assembly in a beverage with the upper end zone of the elongate segment extending above and out of the beverage when a garnish is piercingly captivated on the lower end zone of the toothpick assembly. Further, the upper end zone includes an upper end segment adapted to be matingly secured to the float means within an axial slot which extends downwardly into the float means through its upper surface. This upper end segment includes an accessible finger gripping surface so that the assembly may be lifted from the beverage and the garnish removed thereby.

It is generally an object of this invention to provide an assembly of the type described which is simple and inexpensive in construction and well adapted for the purposes set forth herein, primarily for ease of removal of the garnish from a beverage.

Yet another object of the present invention is to provide an improved floatable toothpick assembly which is cost effective to manufacture in large quantities due to a separate upper end segment to be matingly secured within the float means.

BRIEF DESCRIPTION OF THE DRAWINGS

For a fuller understanding of the nature of the present invention, reference should be had to the following detailed description taken in connection with the accompanying drawings, in which:

FIG. 1 is a perspective view of a beverage in a glass with a floating toothpick assembly according to this invention having a garnish on the lower end and a float means adjacent the upper end zone, so that the upper end zone extends above the liquid;

FIG. 2 is a view in cross-section illustrating the float in a preferred embodiment;

FIG. 3 is a view of a first embodiment of the upper end segment of the present invention;

FIG. 4 is a view of a second embodiment of the upper end segment of the present invention;

FIG. 5 is a side view of the upper end segment of FIG. 3 illustrating the accessible finger gripping surface.

Like reference numerals refer to like parts throughout the several views of the drawings.

DESCRIPTION OF THE PREFERRED EMBODIMENT

In FIG. 1, there is shown a glass 10 having ice cubes such as 12 and beverage indicated at 14 at its upper surface or what could be termed the upper float line. Within the glass, there is an improved floatable toothpick assembly generally indicated by the numeral 16 which is seen to include a toothpick or elongate segment 18 having a lower end zone with a pointed tip as at 20 and an upper opposite end zone as at 22. On a main length 17 of the elongate segment 18, there is a float means 24. The float means 24 are preferably symmetrical with respect to a vertical center line extending between a lower end 26 of the float means 24 and its upper surface 28. The side surface of the float means 24 is designated by the numeral 30. In a preferred embodiment, the upper surface 28 of the float means 24 is between about $\frac{1}{2}$ of an inch and $\frac{3}{4}$ of an inch in diameter with the side surface 30 tapering symmetrically to the lower end 26, as indicated, preferably in a curved decorative design. Extending into the float means 24 through the lower end 26 thereof is the main length 17 of the elongate segment 18. The float means 24 may be slidably disposed on the elongate segment 18, but preferably the elongate segment 18 is fixedly secured and/or is integrally formed with the float means 24, thereby making a single non-adjustable piece. Both can either be molded of the same material or of two different materials.

In the preferred embodiment, the upper opposite end zone 22 includes an upper end segment 40 formed separately from the main length 17 and lower end zone 20 of the elongate segment 18. This upper end segment 40 is adapted to be secured within the float means 24 through its upper surface 28. Specifically, the float means 24 includes an axial slot 32 extending axially therein from said upper surface 28. This axial slot 32 is adapted to receive an attachment end 42 of the upper end segment 40 matingly therein. In order to ensure that secure attachment is maintained between the upper end segment 40 and the float means 24, the attachment end 42 of the upper end segment 40 includes a pattern in relief formed therein. This pattern, as illustrated in the embodiments of FIGS. 3 and 4, may be in the form of spheres, pyramids, or any other pattern which will cause the axial slot 32 to slightly yield upon insertion of the attachment end 42 into the axial slot 32, but will not substantially inhibit the elastic memory of the axial slot 32 such that the axial slot 32 will generally return to its original shape captivating the upper end segment 40 therein. Also, the axial slot 32, as detailed in FIG. 2, will preferably include a corresponding pattern in relief therein so as to matingly receive the upper end segment 40 securably therein. In this manner, the upper segment end 40 can be manufactured separately from the remainder of the assembly 10, and secured in place only as needed or in specific quantities.

In use, a garnish 13 is pierced by the tapered and pointed tip 20 of the lower end zone and, as indicated in FIG. 1, is dropped into the glass 10. It will float in the attitude shown in FIG. 1 where it can be easily removed by lifting it from the glass 10 using the upper end zone 22 to clasp it and retrieve the garnish. The overall length of the assembly 10 is between about 2½ inches and 4½ inches and the cross-sectional diameter of the elongate segment 18 is between 1/16 of an inch and 1/8 of an inch. These dimensions, however, can be varied to meet the specific use requirements present. Further, the garnish 13, as indicated, may be in the form of an olive, cherry and/or a piece of pineapple for example.

In order to facilitate removal of the assembly 10 from the beverage 14, the upper end segment 40 includes an accessible finger gripping surface 44. The finger gripping surface 44 can be, or can include, a decorative portion such as a parasol or other decorative shape, as indicated in the drawings. Preferably, the decorative portion of the finger gripping surface 44 will be adapted to include indicia 45, such as messages, greetings, or advertisements thereon, and can include a generally concave shape, as illustrated in FIG. 5, to facilitate gripping thereof. The benefits of manufacturing the upper end segment .40 separately from the remainder of the assembly 10 is particularly evident when the indicia 45 is depicted thereon. In such cases large quantities of the assembly 10, excluding the upper end segment 40, can be made, with only the specific, desired quantities and styles of upper end segments 40 remaining to be made and secured in place.

While the float means 24 may be of any desired material such as wood, cork, or plastic, it is only required that it have sufficient buoyancy so that its upper surface 28 is at about the level of the drink 14 when it is served; and, therefore, the upper end segment 40 will extend out of the drink 14 so that it is visible and can be grasped conveniently by a user, the assembly 10 floating in a generally upright position with garnish 13 on the lower end zone.

While this invention has been shown and described in what is considered to be a practical and preferred embodiment, it is recognized that departures may be made within the spirit and scope of this invention which should therefore not be limited except as set forth in the claims and within the doctrine of equivalence.

Now that the invention has been described, what is claimed is:

1. A floatable toothpick assembly comprising: an elongate segment having a lower end zone with a pointed tip, an upper opposite end zone and a main length of generally cylindrical uniform cross-section between the end zones, and a buoyant float means with a) an upper surface, b) a lower end, and c) a side surface extending between the upper surface and the lower end, said float means being disposed on said main length adjacent said upper opposite end zone, and said float means being sufficiently buoyant so as to float in a beverage with the upper opposite end zone extending above a top level of a beverage when a garnish is piercingly captivated adjacent the lower end zone, the upper end zone including an upper end segment adapted to be matingly secured to the float means, the float means including an axial slot extending downwardly from the upper surface of the float means wherein an attachment end of the upper end segment is disposed, and the upper end segment including an accessible finger gripping surface for use in lifting the assembly and the garnish thereon from a floating disposition in the beverage.

2. An assembly as set forth in claim 1 wherein the attachment end of the upper end segment includes a pattern in relief formed therein.

3. An assembly as set forth in claim 1 wherein said axial slot of the float means includes a pattern in relief disposed therein, said pattern in relief of said axial slot being structured to correspond said pattern in relief of the attachment end of the upper end segment such that the attachment end of the upper end segment is matingly securable within said axial slot of the float means.

4. An assembly as set forth in claim 1 wherein said accessible finger gripping surface of the upper end segment includes a decorative portion.

5. An assembly as set forth in claim 4 wherein said decorative portion includes indicia thereon.

6. An assembly as set forth in claim 1 wherein the elongate segment is made of wood.

7. An assembly as set forth in claim 1 wherein the elongate segment is of plastic material.

8. An assembly as set forth in claim 1 wherein said upper surface of said float means is of a greater cross-sectional area than the lower end and said side surface, extending between the upper surface and lower end, tapers.

9. An assembly as set forth in claim 1 wherein said lower end zone, said main length and said float are integral.

* * * * *